United States Patent [19]

Grand

[11] Patent Number: 4,890,819

[45] Date of Patent: Jan. 2, 1990

[54] MACHINE FOR HEAT TREATING CAMSHAFTS

[75] Inventor: Jean-Pierre Grand, La Celle-Saint-Cloud, France

[73] Assignees: Automobiles Peugeot; Automobiles Citroen, both of France

[21] Appl. No.: 187,217

[22] Filed: Apr. 28, 1988

[30] Foreign Application Priority Data

May 7, 1987 [FR] France ..... 87 06503

[51] Int. Cl.[4] ..... C21D 9/30

[52] U.S. Cl. ..... 266/78; 148/152

[58] Field of Search ..... 148/903, 152, 146, 321; 266/78, 80, 99, 249, 261

[56] References Cited

U.S. PATENT DOCUMENTS

| | | | |
|---|---|---|---|
| 2,242,158 | 5/1941 | Wasson et al. | 266/99 |
| 4,312,685 | 1/1982 | Riedl | 148/146 |
| 4,720,312 | 1/1988 | Fukuizumi et al. | 148/152 |
| 4,761,192 | 8/1988 | Saga et al. | 148/152 |

FOREIGN PATENT DOCUMENTS

| | | |
|---|---|---|
| 2839990 | 8/1979 | Fed. Rep. of Germany . |
| 3224745 | 7/1983 | Fed. Rep. of Germany . |
| 3626808 | 2/1987 | Fed. Rep. of Germany . |
| 2378864 | 8/1978 | France . |

*Primary Examiner*—S. Kastler

*Attorney, Agent, or Firm*—Steinberg & Raskin

[57] ABSTRACT

The present invention concerns a machine for heat treating camshafts, this machine comprising essentially torches likely to produce an electric arc and carried by a carriage which is movable owing to a binary control motor along a horizontal direction parallel to the axis of the camshaft to be treated, this carriage being carried by an intermediate carriage movable owing to another binary control motor along a horizontal direction perpendicular to the axis of the camshaft, which intermediate carriage is mounted in a vertically movable manner on the frame of the machine along a vertical direction perpendicular to the axis of the camshaft owing to still another binary control motor carried by the frame.

11 Claims, 3 Drawing Sheets

Fig. 2
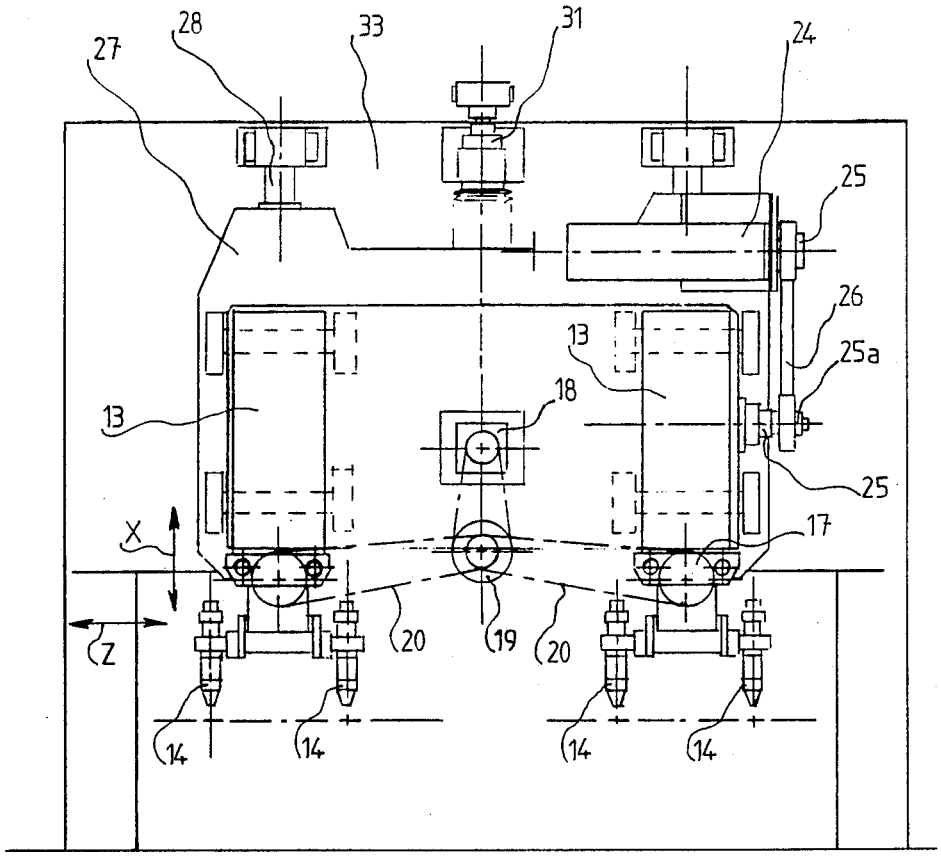
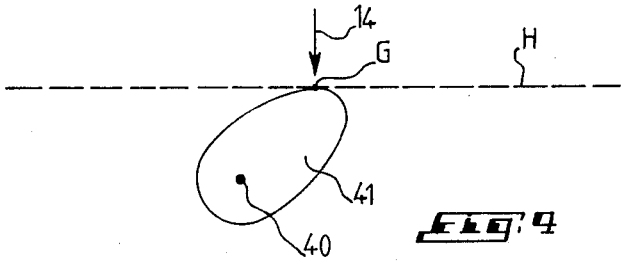
Fig. 4

MACHINE FOR HEAT TREATING CAMSHAFTS

BACKGROUND OF THE INVENTION

The present invention concerns a machine for heat treating through remelting the surface of cams carried by a camshaft.

It is known that the remelting is a heat treatment method which consists in forming a localized fusion on a surface, such as a cam surface, with an electric arc surrounded by an inert gas jet and produced by a torch. A "quenching" or hardening of the cam surface is thus obtained, which surface is generally scanned by the electric arc in such a manner that the treatment is carried out over the whole surface to be treated.

More precisely, according for example to the document U.S. Pat. No. 4,312,685, camshaft remelting machines are known in which a vertical movement of the torch is performed with the aid of a main cam so that the torch is at a constant distance from the surface to be treated, the camshaft itself being actuated in a rotation movement combined with an axial translation movement in order to perform the scanning.

Such a machine presents drawbacks resulting in particular from the fact that the point of impact of the torch is generally located on an inclined surface of the cam in particular when the latter has a pointed top, and it follows from the foregoing that the electric arc of the torch forms a recess or a cavity on the cam surface, since the molten metal flows as a result of the tilting of said surface. In other words, after the remelting treatment, a cam surface is obtained which is inappropriate for the utilization and which necessitates an important reprocessing.

SUMMARY OF THE INVENTION

The present invention has as an object in particular to meet these drawbacks by proposing an improved machine for heat treating through remelting cams carried by camshafts, which machine is by no way likely to deteriorate the cam surface and permits advantageously treating automatically identical and different camshaft series.

For this purpose, the invention has as an object a machine for heat treating through remelting cams carried by a camshaft and of the type comprising means for rotating the shaft around its horizontally disposed axis, at least one torch likely to perform a fusion with an electric arc on a point of the surface of the cam to be treated, and means for moving this torch with respect to the camshaft, characterized by independent binary control means which permit the displacement of the torch along three orthogonal directions, i.e. a first vertical direction perpendicular to the axis of the camshaft, a second horizontal direction parallel to the axis of the camshaft, and a third horizontal direction perpendicular to the axis of the camshaft.

According to another feature of the invention, the displacement of the torch along the aforesaid third direction is controlled by an independent binary control means which permits the torch to be located on the generating line in contact with the horizontal tangent plane.

Thus, it is understood that the heat treatment through remelting is always carried out on a portion of the cam surface which is located in a horizontal plane, so that there is practically no more risk for cavities to be formed in this cam surface, as previously explained.

According to another feature of the invention, the aforesaid torch is carried by a carriage which is movable owing to a binary control motor along the aforesaid second direction, this carriage being itself carried by an intermediate carriage which is movable owing to another binary control motor along the aforesaid third direction, which intermediate carriage is mounted in a vertically movable manner on the frame of the machine along the first direction owing to still another binary control motor.

It is still to be precised here that the machine according to this invention comprises a number of torches which is equal to the number of cams or of cam pairs carried by the shaft to be treated and to the number of identical camshafts which can be simultaneously treated by the machine, each one of the said shafts being initially oriented by an indexing system so that the treatment starts in an identical manner on all the cams of the shafts.

This indexing system which is associated to the means for rotating each shaft, comprises one finger co-operating with a groove made on the shaft.

According to another feature of the invention, the aforesaid intermediate carriage is formed of one bracket-shaped element of which one side carries the aforesaid carriage and of which the other side is mounted in an horizontally movable manner on a plate or the like which is itself mounted in a vertically sliding manner on the frame of the machine.

The displacement of the aforesaid carriage(s) which carries (carry) the torches is performed by roller screws controlled by belts actuated by a binary control motor which is carried by the aforesaid bracket or intermediate carriage.

As for the horizontal displacement perpendicularly to the shaft axis of the aforesaid intermediate carriage, this displacement is performed by a ball screw actuated by a binary control motor carried by the aforesaid plate which is provided with rods on which the said intermediate carriage can slide.

The vertical displacement of the aforesaid plate on the machine frame is performed by a binary control motor carried by the said frame which is provided with vertical rods on which sleeves or the like solid with the plate slide.

According to still another feature of the invention, the displacements of the torches along the aforesaid three orthogonal directions, as well as the movement of rotation of the camshaft are controlled by a computer in which all the relative positions at any moment are stored.

According to still another feature of the machine according to this invention, each torch can make in the vertical plane perpendicular to the camshaft an angular displacement defined by a binary control motor carried by the carriage which carries the torch.

According to another embodiment, the machine of the invention comprises a plurality of torches, each torch being carried by a carriage likely to make a vertical movement, this carriage being carried by an intermediate carriage likely to make an horizontal movement perpendicularly to the shaft and all the intermediate carriages being carried by a unique carriage likely to make a horizontal movement in a parallel direction to the shaft.

BRIEF DESCRIPTION OF THE DRAWINGS

Other features and advantages of the invention will appear more clearly in the course of the following ddetailed description with reference to the appended drawings, given by way of example only, and wherein:

FIG. 2 is a diagrammatic view of this machine along arrow II of FIG. 1;

FIG. 4 is a diagrammatic view showing the manner in which the impact fo the electric arc produced by the torch is performed along a horizontal plane which is tangent to the generating lines of the said cam.

DESCRIPTION OF THE PREFERRED EMBODIMENTS

Figure 1:
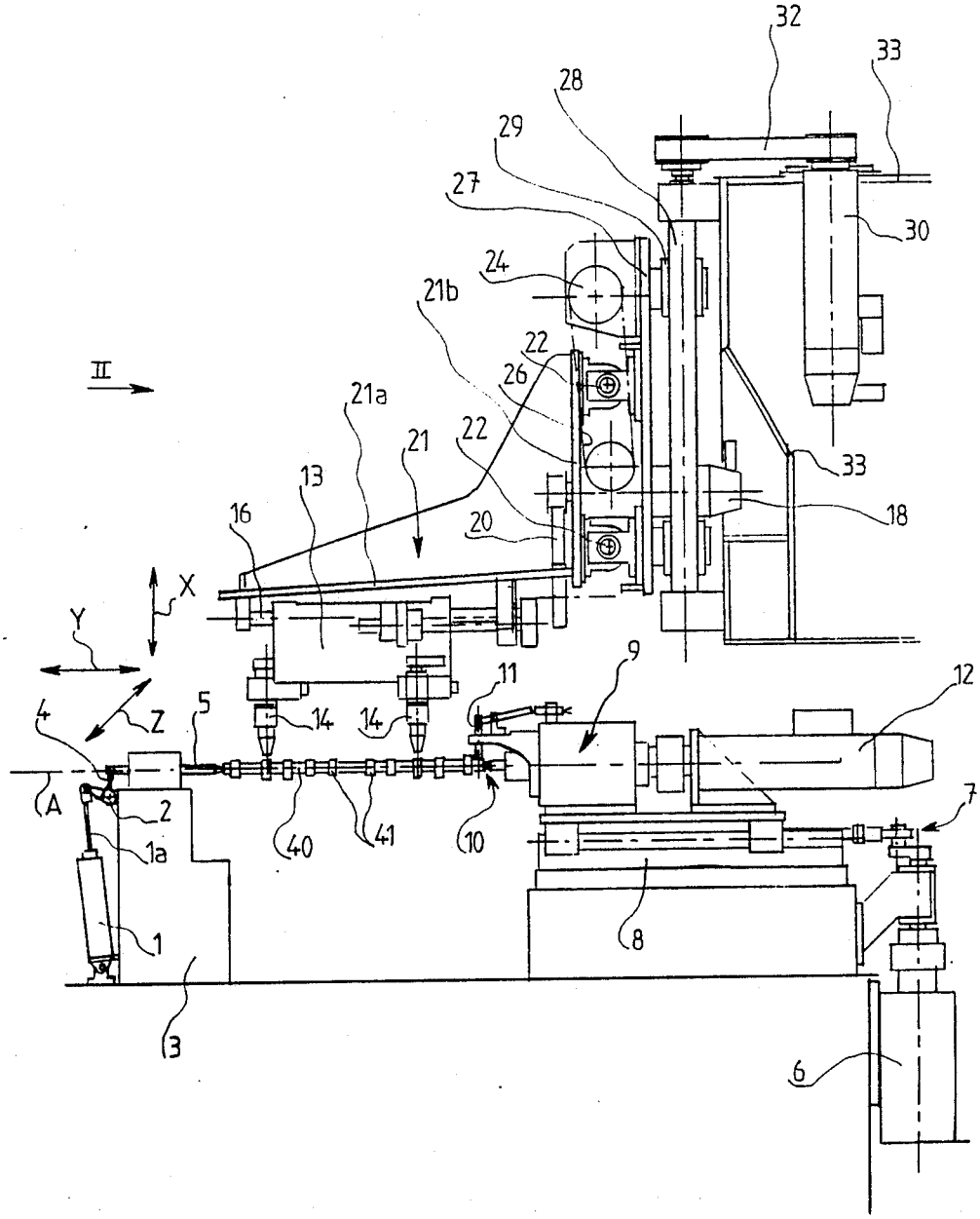
FIG. 1 is a diagrammatic elevational side view of a machine according to the principles of the invention.
Figure 3:
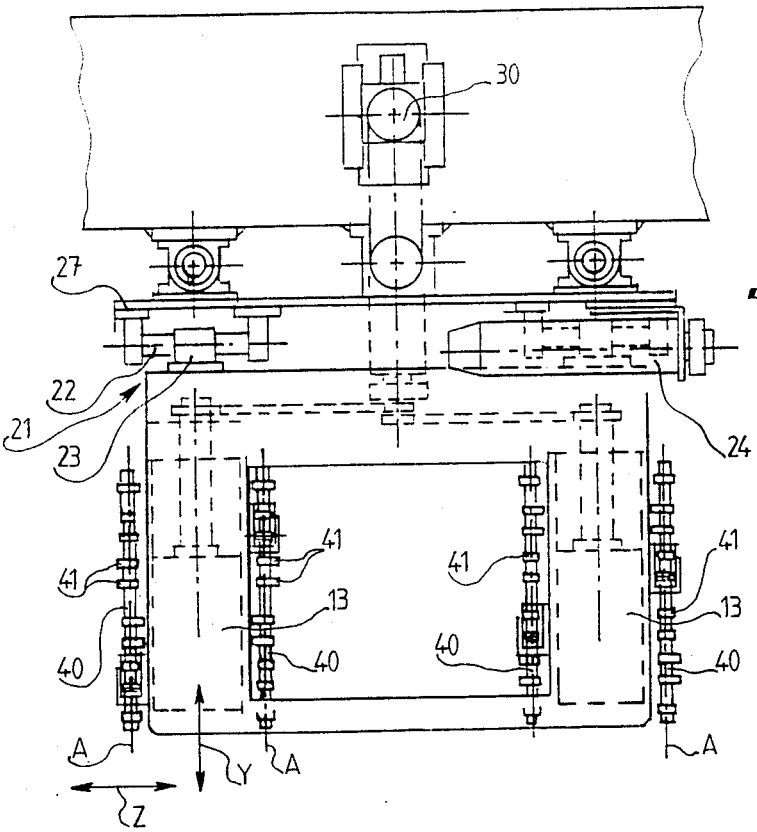
FIG. 3 is a diagrammatic top view of this machine.

Referring to FIGS. 1 to 3, it is seen that a machine according to the principles of the invention comprises essentially one frame 33 carrying torches 14 which are movable above shafts 40 each of which carrying a plurality of cams 41, these shafts being carried horizontally and being in a condition to rotate about their axis A.

The shafts 40 are carried by a lower frame 3 on which a cylinder 1 is articulated which actuates through its rod 1*a* and through a connecting rod, a control rod 2. This control rod 2 which is secured to frame 3 by bearings is equipped with four connecting rods 4 acting respectively on four back centers 5 maintaining an end of the shafts 40, as seen on the left lower part of FIG. 1.

The other end of the shafts 40 is maintained by means which will now be described and which permit the rotation of the shafts 40 during the heat treatment through remelting.

As clearly seen in FIG. 1, a motor 6 permits, through a connecting rod-crank system 7 the alternative displacement (forward and backward displacement) of a carriage 8 carrying a system 9 provided with a driving center 10. An indexing finger 11 is associated to this system 9, this finger co-operating with a groove not shown made in the shaft 40.

The system 9 requires no detailed description and it is sufficient to say here that it permits the pivoting of the shaft 40 in order to find the indexing position thereof and the rotation of the indexing assembly according to the processing program. In other words, the shaft 40 rotates until the finger 11 latches in the shaft groove, and at this moment, the shaft is correctly oriented in its initial position to permit the remelting cycle to start.

A motor is shown at 12 which, through an appropriate transmission, permits rotatably actuating the centers 10 and thus the shafts 40 about their axis A.

Turning back to the torches 14, these can move with respect to the frame 33 along three orthogonal directions, i.e., as seen in the Figures, a first vertical direction X perpendicular to the axis A of the shafts, a second horizontal direction Y parallel to axis A, and a third horizontal direction Z perpendicular to the axis A, this displacement along the three aforesaid directions being likely to occur while the shafts are rotatably actuated by the motor 12. All the movements are controlled by separated binary control motors, under the control of a computer in which all the motion laws are stored, and this in such a manner that the point of impact of the electric arc of the torches is located on the generating line in contact with the horizontal tangent plane, as will be explained later.

The torches 14, as clearly seen in FIGS. 1 to 3, are carried by two carriages 13 each of which carrying two torches 14 and being guided on rods 16 clearly seen in FIG. 1, along direction Y, i.e. in a parallel direction to the axis A of the camshafts 40.

The displacement of the carriages 13 is performed by a binary control motor 18 which acts on roller screws 17 of each carriage 13, through pulleys 19 and synchronous belts 20 (FIG. 2).

The above-described assembly, formed essentially of the carriages 13 and of the motor 18, is carried by an intermediate carriage in the shape of a bracket 21 clearly seen in FIG. 1.

The displacement of this bracket along direction Z, i.e. in a horizontal direction and perpendicularly to the axis A of shaft 40, is performed by a binary control motor 24 which acts upon a ball screw 25 (FIG. 2) through pulleys 25*a* and through a synchronous belt 26. The bracket 21 is guided by rods 22 and by sleeves 23 (see in particular FIG. 3), so that the said bracket can move along direction Z.

The above assembly, i.e. the motor 24 and the rods 22 slidably supporting the bracket 21, is supported by a plate 27 which is clearly seen in FIGS. 1 to 3.

This plate 27 is mounted in a vertically sliding manner along direction X on the upper frame 33 of the machine.

More precisely, the frame 33 includes vertical rods 28 on which ball sleeves 29 solid with the plate 27 can move.

Thus, a binary control motor 30, carried by the frame 33, can act upon a ball screw 31 (FIG. 2) through pulleys and through a synchronous belt 32 to control the vertical displacement of the plate 27 and therefore, the vertical displacement of the bracket 21 and of the carriages 13.

As clearly seen in FIG. 1, the bracket 21 comprises one side 21*a* carrying the carriages 13 and another side 21*b* which is movably mounted in a horizontal direction on the plate 27 which is itself mounted in a vertically sliding manner on the upper frame 33 of the machine.

This machine can perfectly comprise, without departing from the scope of the invention, another motor (not shown) disposed between the carriage 13 and the torches which are associated therewith, to permit each torch to move angularly in the vertical plane perpendicular to the camshaft 40, in order to be in a position to direct the torch in an appropriate manner, towards the center of the piece to be processed.

It is important to notice here that the displacement of the torches 14 along the axis Z is provided to permit the point of impact of the torch to be located, as clearly seen in FIG. 4, on the generating line G in contact with the horizontal tangent plane H. In other words, the torch 14, owing to the programming, will steadily seek the generating line G of cam 41 having a horizontal tangent plane in order to produce the electric arc at that point. Thus, the cavity phenomena appearing on the surface of the cam 41 will be advantageously avoided, since the impact will always occur on an horizontal part of the cam, and this while the shaft 40 is being rotatably actuated.

Besides, it is to be noted that the torches 14 will undergo an alternative movement along direction Y parallel to the axis A of shaft 40 so as to scan approximately the whole width of the surface of cams 41 during the rotating of the said shaft.

This movement of rotation of the shaft 40 with cams 41 about its axis A will be sufficiently slow with respect to the aforesaid alternative movement for the scanning to occur with overlapping.

The operation of the machine which has just been described will now be explained briefly more particularly with reference to FIG. 5 which represents four shafts 40 comprising four cams or four identical pairs of cams (A, B, C and D), all the cams having the same profile but different orientations. The torches 14 perform of course the same movement and, as seen in FIG. 5, are disposed so as to treat simultaneously one cam on the four shafts.

Figure 5:
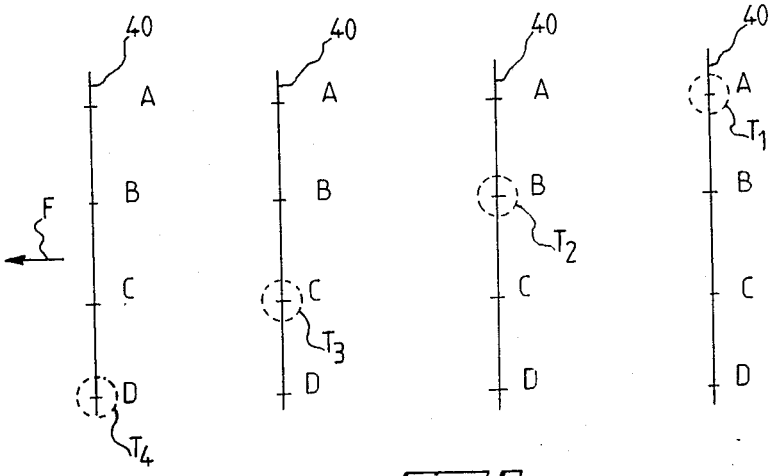
FIG. 5 is a diagrammatic view, corresponding substantially to FIG. 3 and showing the manner in which four identical cammshafts are treated by the machine.

In other words, after the four shafts have been oriented owing to the indexing system described previously, the first torch $T_1$ treats the cam A of the first shaft, the torch $T_2$ treats the cam B of the second shaft and so on, it being understood that after the cams A, B, C and D belonging respectively to the four shafts 40 have been treated, the four shafts are displaced with the aid of an appropriate system, along the direction of arrow F, so that the cam B of the first shaft located on the right part of the FIG. 5, is treated by the torch $T_2$, that the cam C of the second shaft is treated by the torch $T_3$, and so on.

The machine which has just been described permits treating a unique category of shafts 40, as has been sadi previously.

If it is wanted to treat a second category of camshafts following the first category of shafts, it is necessary to finish completely the treatment on the first category of shafts before switching the machine on another program.

Therefore, according to another embodiment of the invention, each torch 14 can be carried by a carriage likely to make a vertical movement, this carriage being carried by an intermediate carriage likely to make a horizontal movement perpendicular to the shaft and all the intermediate carriages being carried by a unique carriage which can make a horizontal movement parallel to the shaft, position finding means forming for example an optical mark being provided in order to switch the torch on the appropriate program before starting the heat treatment. In other words, it is possible to make the different torches perform simultaneously different programs with the proviso that all the cams have the same range width.

Thus, according to the invention, there has been obtained a machine comprising torches whose displacement can be programmed and in which the motion laws along the different directions can be modified, and which permits carrying out a heat treatment through remelting on each cam in an homogeneous, efficient manner with a lower risk of deterioration of the cam range.

Of course, the invention is by no way limited to the described and illustrated embodiments which have been given by way of example only.

On the contrary, the invention comprises all the technical equivalents of the described means as well as the combinations thereof provided that these are carried out according to its spirit.

What is claimed is:

1. A machine for heat treating through remelting cams carried by a cam shaft comprising:

means for rotating the shaft around its horizontally disposed axis, at least one torch adapted to perform a fusion with an electric arc on a point of the surface to be treated, and means for moving this torch with respect to the camshaft along three orthogonal directions, namely a first vertical direction perpendicular to the axis of the camshaft, a second horizontal direction parallel to the axis of the camshaft, and a third horizontal direction perpendicular to the axis of the camshaft, this machine comprising independent binary control means performing respectively the rotation of the shaft and the displacements of said torch along the aforesaid three axes, and in such a manner that the independent binary control means actuating the torch along the third direction permits the point of impact of this torch to be located on a generating line of the cam in contact with the horizontal tangent plane.

2. A machine according to claim 1, wherein the displacements of the torches along the three orthogonal directions as well as the movement of rotation of the camshaft are controlled by a computer in which all the relative positions at any moment are stored.

3. A machine according to claim 1, wherein the aforesaid torch is carried by a carriage which is movable owing to a binary control motor along the aforesaid second direction, this carriage being itself carried by an intermediate carriage which is movable owing to another binary control motor along the said third direction, which intermediate carriage is mounted in a vertically movable manner on the frame of the machine along the said first direction owing to still another binary control motor.

4. A machine according to claim 1, comprising a number of torches which is equal to the number of cams or of pairs of cams carried by the shaft and to the number of identical camshafts which are to be simultaneously treated by the machine, and said machine is provided with an indexing system for initially orienting each one of said shafts so that the treatment starts in an identical manner on all the cams.

5. A machine according to claim 4, wherein the indexing system, associated with the aforesaid means for rotating each shaft, comprises one finger cooperating with a groove made on the shaft.

6. A machine according to claim 3, wherein the aforesaid intermediate carriage is formed of one bracket-shaped element of which one side carries the aforesaid carriage and of which the other side is mounted in a horizontally movable manner on a plate which is itself mounted in a vertically sliding manner on the frame of the machine.

7. A machine according to claim 3, wherein the displacements of the aforesaid carriage or carriages carrying the torches are performed by roller screws controlled by belts actuated by a binary control motor which is carried by the aforesaid bracket or intermediate carriage.

8. A machine according to claim 3, wherein the horizontal displacement perpendicular to the shaft axis of the aforesaid intermediate carriage is performed by a ball screw actuated by a binary control motor carried by the aforesaid plate which is provided with rods on which the said intermediate carriage can slide.

9. A machine according to claim 6, wherein the vertical displacement of the aforesaid plate on the machine frame is performed by a binary control motor carried by the said frame which is provided with vertical rods on which sleeves solid with said plate slide.

10. A machine according to claim 1, wherein each torch can make in the vertical plane perpendicular to the camshaft an angular displacement defined by a binary control motor carried by the carriage which carries the torch.

11. A machine according to claim 1, comprising a plurality of torches, each torch being carried by a carriage adapted to move vertically, this carriage being carried by an intermediate carriage adapted to make a horizontal movement perpendicular to the shaft, and all the intermediate carriages being carried by a unique carried which is horizontally movable in a parallel direction to the shaft.

* * * * *